US011745921B2

(12) United States Patent
Ou et al.

(10) Patent No.: US 11,745,921 B2
(45) Date of Patent: Sep. 5, 2023

(54) SEALING COVER WITH TWO-WAY EMBEDDING BUCKLE MECHANISM

(71) Applicant: FREE-FREE INDUSTRIAL CORP, Taipei (TW)

(72) Inventors: Cheng-Yu Ou, Taipei (TW); Sheng-Yu Liu, Taipei (TW)

(73) Assignee: FREE-FREE INDUSTRIAL CORP, Taipei (TW)

( * ) Notice: Subject to any disclaimer, the term of this patent is extended or adjusted under 35 U.S.C. 154(b) by 378 days.

(21) Appl. No.: 17/313,937

(22) Filed: May 6, 2021

(65) Prior Publication Data

US 2021/0269200 A1 Sep. 2, 2021

Related U.S. Application Data

(63) Continuation-in-part of application No. 16/269,554, filed on Feb. 6, 2019, now Pat. No. 11,027,900.

(51) Int. Cl.
*B65D 43/02* (2006.01)
*B65D 51/24* (2006.01)

(52) U.S. Cl.
CPC ..... *B65D 43/0222* (2013.01); *B65D 51/242* (2013.01); *B65D 2543/00203* (2013.01);
(Continued)

(58) Field of Classification Search
CPC ..... B65D 43/0222; B65D 51/242; B65D 2543/00203; B65D 2543/00518;
(Continued)

(56) References Cited

U.S. PATENT DOCUMENTS 326,641 A * 9/1885 Guptill ..... B65D 39/12 215/359
634,240 A * 10/1899 Hoyt ..... B65D 39/12 215/364

(Continued)

FOREIGN PATENT DOCUMENTS

CN 201439404 U 4/2010
CN 205989902 U 3/2017

OTHER PUBLICATIONS

Office Action dated May 18, 2021 of the parent application's corresponding China patent application No. 201910126337.X.

(Continued)

*Primary Examiner* — Nathaniel C Chukwurah
*Assistant Examiner* — Lucas E. A. Palmer
(74) *Attorney, Agent, or Firm* — Chun-Ming Shih; HDLS IPR SERVICES

(57) ABSTRACT

A sealing cover with a two-way embedding buckle mechanism includes an upper cover member, a lower cover member, a fastener, an elastic element and a handle member. The fastener has two embedded buckle channels corresponding to each other, each includes a sliding path, a first embedding port and a second embedding port. The first and second embedding ports are formed on two ends of the sliding path respectively. The elastic element is elastically clamped between the upper and lower cover members. The handle member includes a knob handle and two support arms, and each support arm has a shaft, and each shaft selectively enters one of the first and second embedding ports and is capable of moving in each sliding path. This arrangement may improve the convenience of assembling and disassembling.

10 Claims, 6 Drawing Sheets

(52) U.S. Cl.
CPC ..... *B65D 2543/00231* (2013.01); *B65D 2543/00518* (2013.01); *B65D 2543/00546* (2013.01); *B65D 2543/00851* (2013.01); *B65D 2543/00972* (2013.01)

(58) Field of Classification Search
CPC ..... B65D 2543/00546; B65D 2543/00851; B65D 2543/00972
See application file for complete search history.

(56) References Cited

U.S. PATENT DOCUMENTS 2,822,108 A * 2/1958 Moeller ..... B65D 39/12 220/238
3,087,641 A * 4/1963 Millard ..... E05D 11/0054 220/238
3,093,220 A * 6/1963 Modrey ..... F16B 2/185 24/453
3,295,712 A * 1/1967 Peterson ..... B65D 39/12 220/238
3,756,480 A * 9/1973 Swett ..... B65D 43/022 222/484
4,993,246 A * 2/1991 Kopper ..... B65D 39/12 292/240
5,110,002 A * 5/1992 Tucker ..... B65D 71/50 220/717
5,845,800 A * 12/1998 Shaw ..... B60K 15/0406 220/210
6,276,545 B1 * 8/2001 Ferrari ..... B65D 45/34 285/318
6,745,914 B2 * 6/2004 Hagano ..... B60K 15/0406 220/203.24
7,513,381 B2 * 4/2009 Heng ..... B65D 51/1683 220/806
8,056,745 B2 * 11/2011 Yu ..... A47J 41/0027 220/254.3
9,469,449 B1 * 10/2016 Fields ..... B65D 43/265
10,737,847 B1 * 8/2020 Liu ..... B65D 43/06
10,925,375 B2 * 2/2021 Lefevre ..... A45D 40/222
2007/0241107 A1 * 10/2007 Matsumoto ..... B65D 45/327 220/238
2008/0179274 A1 * 7/2008 Cheng ..... A45F 3/16 220/238
2009/0114653 A1 * 5/2009 Schenker ..... B65D 25/32 220/789
2010/0084365 A1 * 4/2010 Liu ..... B65D 39/12 215/317
2011/0036837 A1 * 2/2011 Shang ..... B65D 45/34 220/240
2012/0012584 A1 * 1/2012 Chameroy ..... A47J 27/09 220/203.01
2012/0305558 A1 * 12/2012 Steininger ..... B65D 43/022 220/235
2013/0313219 A1 * 11/2013 Pao ..... B65D 43/022 215/262
2014/0251995 A1 9/2014 Liu
2016/0000271 A1 * 1/2016 Park ..... B65D 45/20 220/203.29
2017/0190479 A1 * 7/2017 Liu ..... B65D 53/02
2018/0265263 A1 * 9/2018 Li ..... B65D 43/0202

OTHER PUBLICATIONS

Search Report dated Apr. 24, 2019 of the parent application's corresponding PCT patent application No. PCT/US2019/016932.

* cited by examiner

SEALING COVER WITH TWO-WAY EMBEDDING BUCKLE MECHANISM

CROSS-REFERENCE TO RELATED APPLICATION

This application is a continuing-in part application of U.S. patent application Ser. No. 16/269,554, filed on Feb. 6, 2019, and entitled "CAP CLOSING STRUCTURE FOR SEALED CONTAINER". The entire disclosures of the above application are all incorporated herein by reference.

BACKGROUND OF THE DISCLOSURE

Technical Field

The technical field of this disclosure relates to a cover of a sealing jar, and more particularly to a sealing cover with a two-way embedding buckle mechanism.

Description of Related Art

In general, a sealing jar has a container and an airtight cover mounted on an opening of the container to detachably cover the container. In order to seal the opening of the container, a gasket such as a ring gasket is embedded in the bottom of the cover and air-tightly stacked on the opening of the container to achieve the effect of sealing the periphery of the opening.

Since it is necessary to remove and clean the sealing cover, related-art manufacturers have developed a sealing cover with a handle and an elastic element, and the sealing cover can be used to pull and press the handle, and the elasticity of the elastic element can squeeze and deform the gasket to achieve the sealing effect. However, some of the sealing covers of this sort have to remove most of the parts in assembly and disassembly processes, but some of the sealing covers only have a one-way embedding port for the assembly, and thus causing a tremendous inconvenience of assembly and disassembly during the cleaning process.

In view of the aforementioned problem of the related art, the inventor of this disclosure based on years of experience in the related industry to conduct extensive research and experiment, and finally provided a feasible solution to the aforementioned problem.

The objective of this disclosure is to provide a sealing cover with a two-way embedding buckle mechanism and having a two-way embedding port disposed at a fastener to improve the convenience of assembling and disassembling.

SUMMARY OF THE DISCLOSURE

To achieve the aforementioned and other objectives, this disclosure provides a sealing cover with a two-way embedding buckle mechanism, and the sealing cover includes an upper cover member, a lower cover member, a fastener, an elastic element and a handle member. The upper cover member includes a top plate and a through hole formed on the top plate; the lower cover member is disposed under the upper cover member and has a bottom plate; the fastener is connected to the bottom plate, passes through the through hole to be exposed from the top plate, and the fastener has two embedded buckle channels corresponding to each other, each includes a sliding path, a first embedding port and a second embedding port, and the first embedding port and the second embedding port are formed on two ends of the sliding path respectively; the elastic element is elastically clamped between the top plate and the bottom plate; and the handle member includes a knob handle and two support arms extending from the knob handle, and each support arm has a shaft, and each shaft selectively enters one of the first and second embedding ports and is capable of moving in each sliding path.

This disclosure has the following effects. With the fastening hole and climbing slope in the sliding path, each shaft may be inserted into the fastening hole to achieve the stabilizing and fixing effects. With the integrally formed bottom plate and seal ring, components may not be missing easily in the removal and cleaning process, and incorrect or incomplete assembly may be prevented effectively. With the sliding path, the handle member may be operated more easily and smoothly while turning or fixing the handle member. The design of this disclosure not only simplifies the overall structure and stabilize the operation, but also provides good sealing effect.

DESCRIPTION OF THE EMBODIMENTS

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
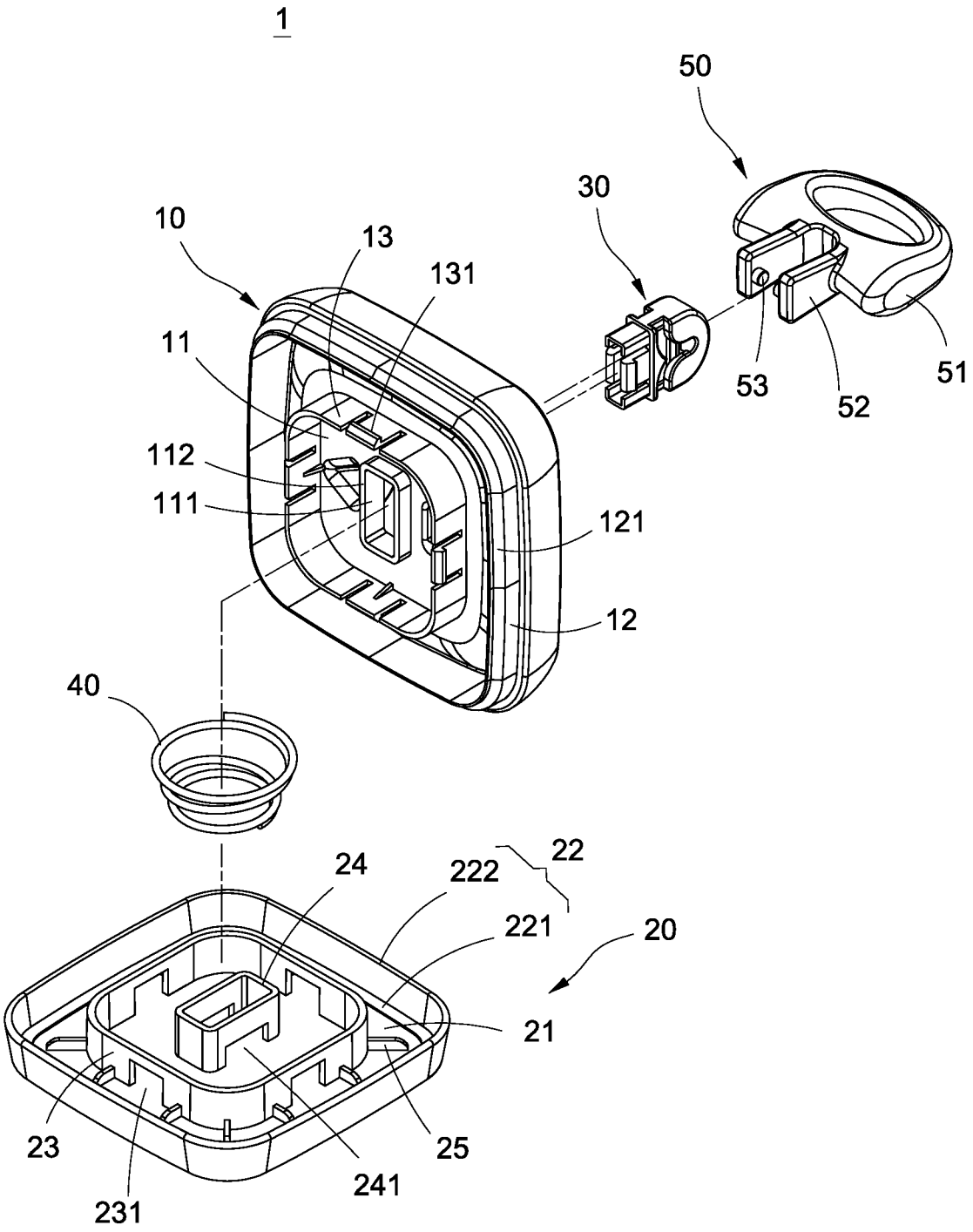
FIG. 1 is an exploded view of a sealing cover with a two-way embedding buckle mechanism of this disclosure.
Figure 2:
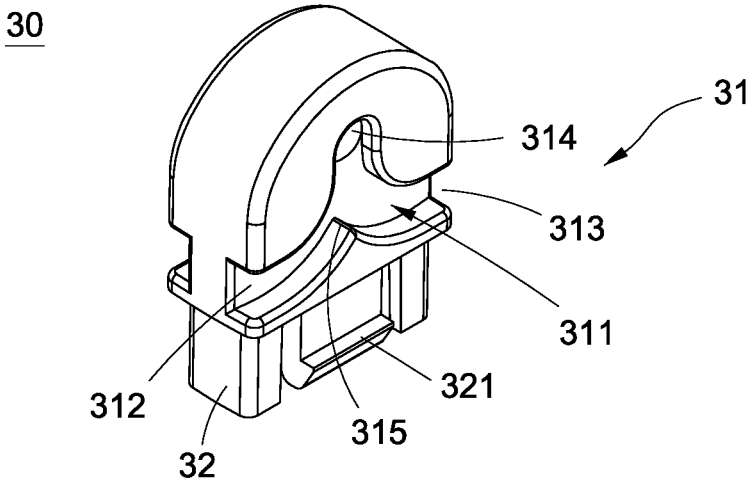
FIG. 2 is a perspective view of a fastener of this disclosure.
Figure 3:
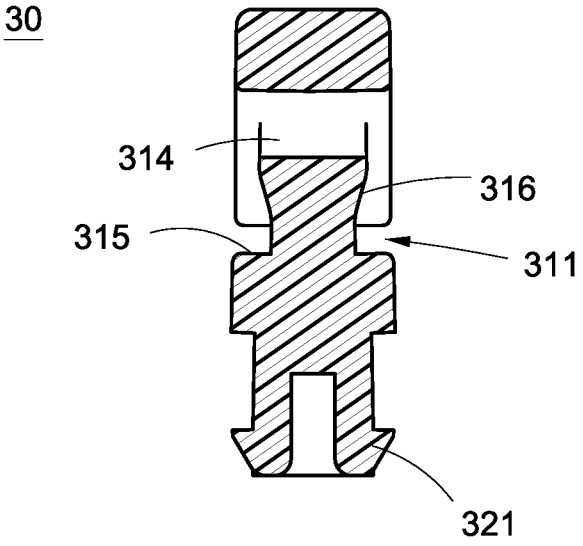
FIG. 3 is a cross-sectional view of a fastener of this disclosure.
Figure 4:
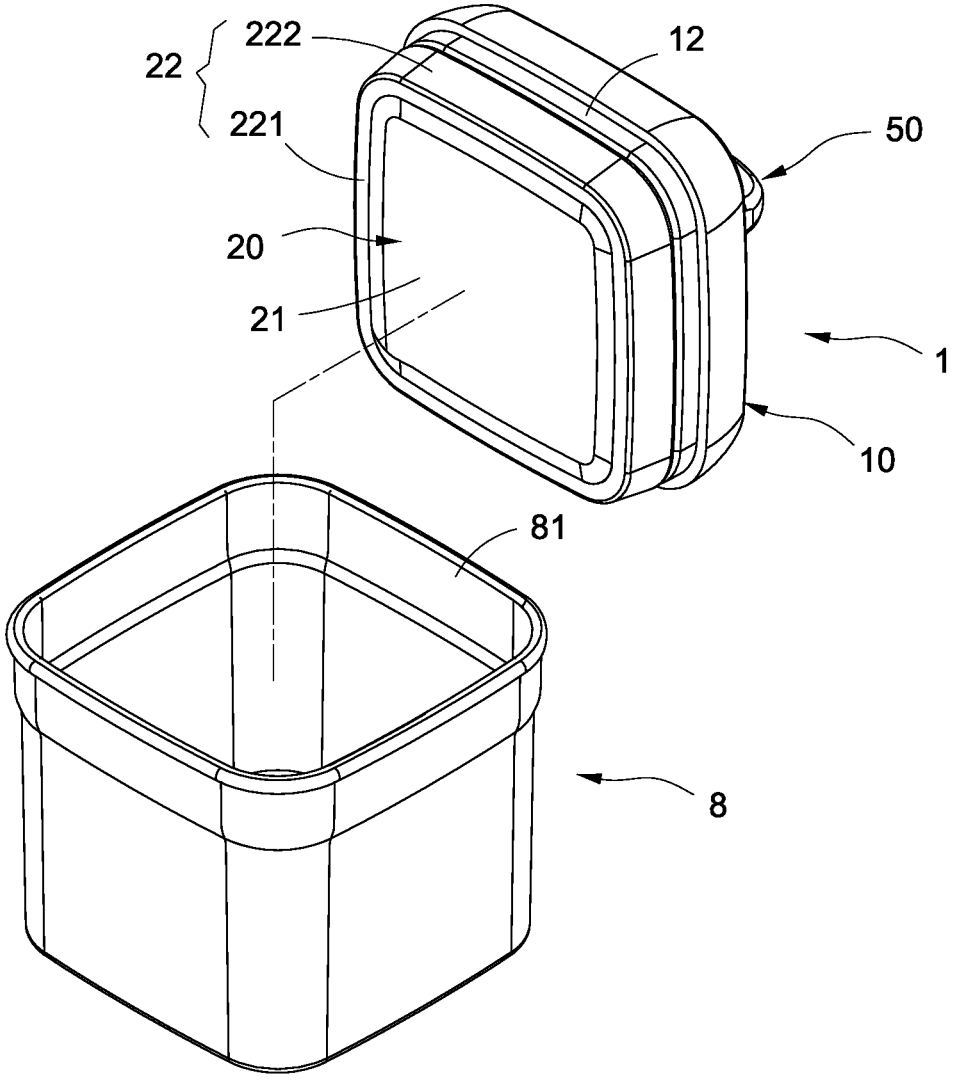
FIG. 4 is an exploded view of a sealing cover with the two-way embedding buckle mechanism and a container in accordance with this disclosure.
Figure 5:
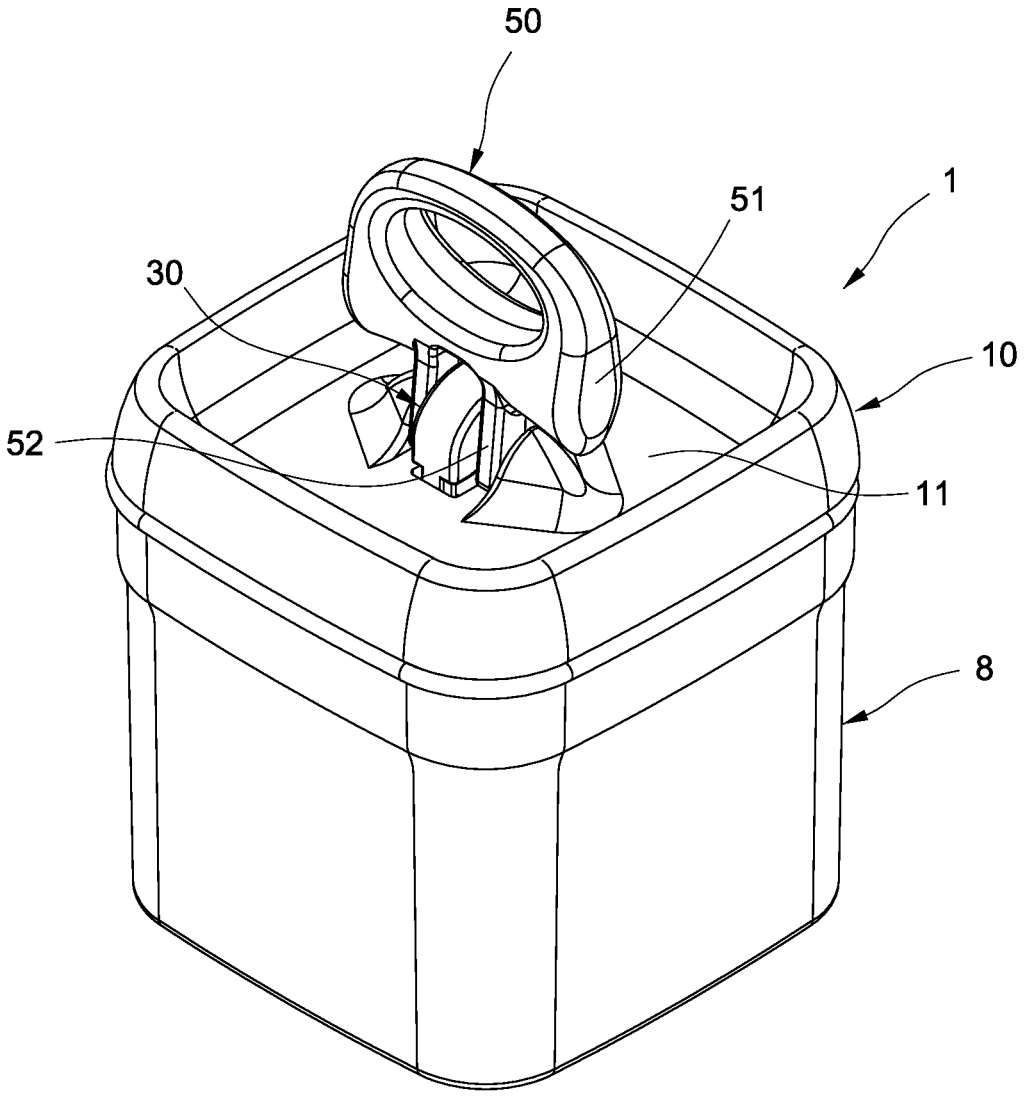
FIG. 5 is a perspective view of a sealing cover with the two-way embedding buckle mechanism and a container in accordance with this disclosure.

With reference to FIGS. 1 to 3 for a sealing cover with a two-way embedding buckle mechanism of this disclosure, the sealing cover 1 includes an upper cover member 10, a lower cover member 20, a fastener 30, an elastic element 40 and a handle member 50.

In an embodiment, the upper cover member 10 is in a quadrilateral shape, but it is not limited to this shape only, and the upper cover member 10 may be made of a plastic material such as polypropylene (PP). The upper cover member 10 includes a top plate 11 and ring frame 12 extended downwardly from the top plate 11, and a through hole 111 is formed on the center position of the top plate 11, and a peripheral wall 112 is extended downwardly from the periphery of the through hole 111. A stop slope 121 is formed on the bottom edge of the ring frame 12. In addition, an upper collar 13 is disposed between the peripheral wall 112 and the ring frame 12 and extended downwardly from the top plate 11. In this embodiment, the upper collar 13 is in a quadrilateral shape, and an elastic hook 131 is disposed on the middle position of each side of the upper collar 13.

The lower cover member 20 is disposed under the upper cover member 10, and the shape is substantially the same as the shape of the upper cover member 10, and the lower cover member 20 may be made of a plastic material such as acrylonitrile butadiene styrene (ABS), and the lower cover member 20 includes a bottom plate 21 and a seal ring 22 connected to the bottom plate 21. The bottom plate 21 and the seal ring 22 are manufactured by injection molding. In this manufacturing method, the bottom plate 21 is manufactured in a mold first, and then the bottom plate 21 is placed into another mold, and finally the liquid material is filled and cured to form the seal ring 2. The bottom plate 21 and the seal ring 22 are inseparable.

Further, the seal ring 22 of this embodiment is made of silicone and is substantially a quadrilateral ring. The seal ring 22 includes a connection section 221 and a squeezed-deformed section 222 extended from the connection section 221, and the connection section 221 is fixed to the periphery of the bottom plate 21, and the squeezed-deformed section 222 is extended in a direction toward the upper cover member 10 and formed on the outer side of the stop slope 121.

Further, the bottom plate 21 is configured to have a lower collar 23 extended corresponding to the upper collar 13, and the lower collar 23 has a hook guide slot 231 formed on the middle position of each side of the lower collar 23, and the lower collar 23 and the upper collar 13 are engaged with each other, and each elastic hook 131 is vertically movable in each hook guide slot 231.

Further, a rectangular frame 24 is extended upwardly from the middle position of the bottom plate 21, and has two snap holes 241 corresponding to each other formed on the side plates of the rectangular frame 24. A plurality of ribs 24 are formed between the outer periphery of the lower collar 23 and the bottom plate 21 for improving the structural strength.

The fastener 30 has two embedded buckle channels 31 corresponding to each other, and each embedded buckle channel 31 includes a sliding path 311, a first embedding port 312 and a second embedding port 313, and the first embedding port 312 and the second embedding port 313 are formed on two ends of the sliding path 311 respectively.

Further, the sliding path 311 is substantially in an inverted V-shape, and has a fastening hole 314 formed on the tip position of the sliding path 311 and a boss 315 formed under the fastening hole 314. In this embodiment, the boss 315 is substantially in a triangular shape. In addition, a climbing slope 316 is disposed on the lower edge of the fastening hole 314 in the sliding path 311. An insert block 32 is disposed on the bottom of the fastener 30, and a snap hook 321 is disposed on the two corresponding sides of the insert block 32 respectively.

The fastener 30 is plugged and connected to the rectangular frame 24 through the insert block 32, and each snap hook 321 is fixed to each snap hole 241 correspondingly and connected to the bottom plate 21, and the fastener 30 passes through the through hole 111 to be exposed from the top plate 11.

The elastic element 40 is a spiral compression spring. The elastic element 40 is adapted to sheathe the rectangular frame 24 and the outer periphery of the peripheral wall 112 and is elastically clamped between the top plate 11 and the bottom plate 21.

The handle member 50 is made of a plastic material such as polyoxymethylene (POM) and includes a knob handle 51 and two support arms 52 extended from the knob handle 51, and each support arm 52 and the knob handle 51 are integrally formed by injection molding, and each support arm 52 has a shaft 53 extended therefrom, and each shaft 53 selectively enters one of the first embedding port 312 and second embedding port 313 and is capable of moving in each sliding path 311, and each shaft 53 passes through each climbing slope 316 and is latched and positioned in the fastening hole 314.

In FIGS. 4 to 7, the sealing cover 1 of this disclosure is combined with a container 8, and the container 8 has an opening 81 formed on the top of the container 8, and the sealing cover 1 covers the opening 81 correspondingly. During assembling, the fastener 30 is plugged into the rectangular frame 24 through the insert block 32, and each snap hook 321 is fixed and connected to each snap hole 241 correspondingly, and the elastic element 40 is adapted to sheathe the rectangular frame 24 and the outer periphery of the peripheral wall 112 and is elastically clamped between the inner surface of the top plate 11 and the bottom plate 21.

Figure 6:
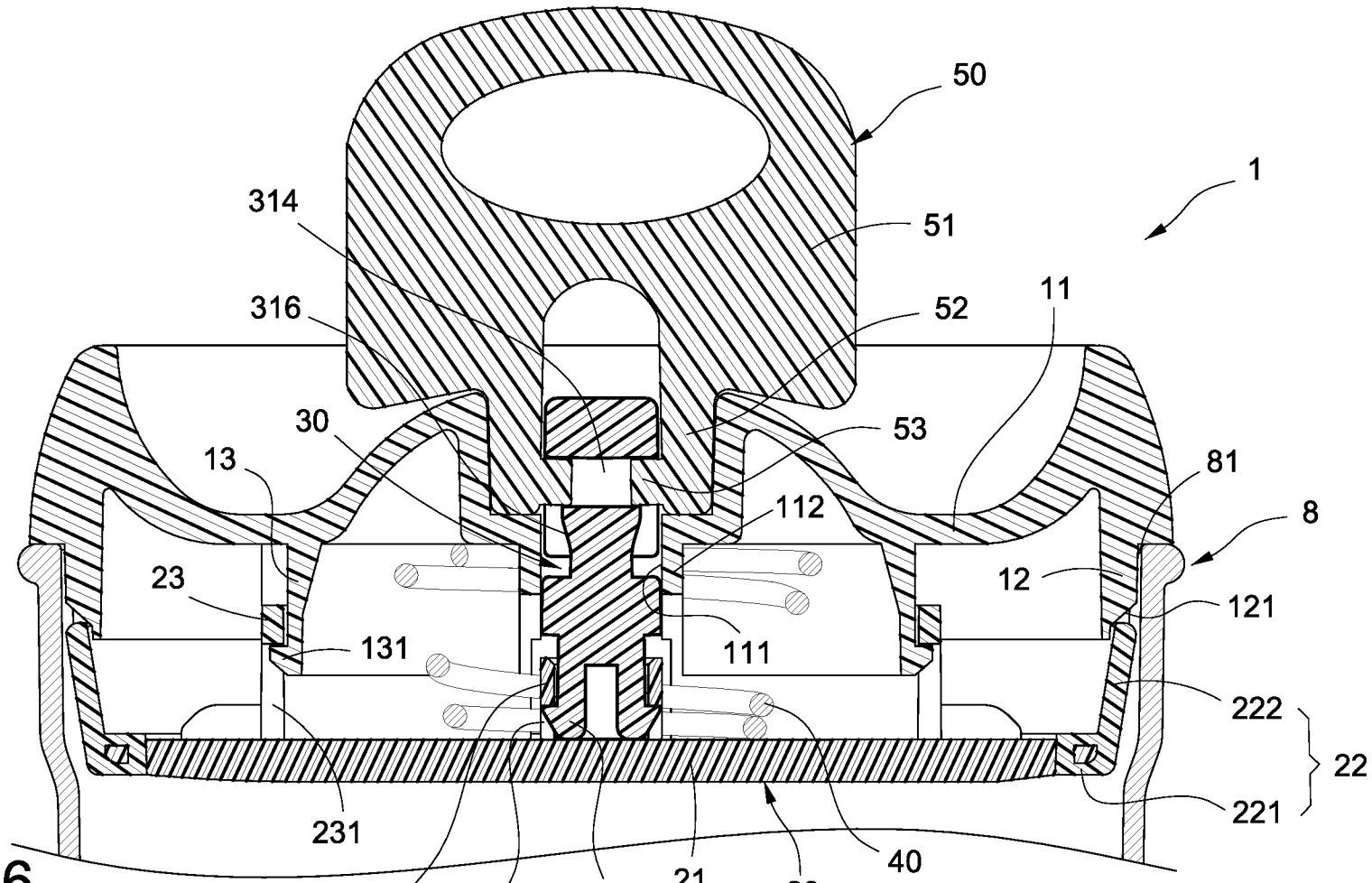
FIG. 6 is a cross-sectional view of a sealing cover with the two-way embedding buckle mechanism and a container in accordance with this disclosure.

And then, the fastener 30 passes through the through hole 111 to press the upper cover member 10 toward the lower cover member 20, so that a part of the fastener 30 is exposed from the top plate 11. Each shaft 53 of the handle member 50 may selectively enter one of each first embedding port 312 and each second embedding port 313, and each shaft 53 passes through each sliding path 311 and reaches the lower edge position of the climbing slope 316. After the handle member 50 is lifted upward, each support arm 52 and each shaft 53 are expanded outwardly along each climbing slope 316, and after each shaft 53 passes through the climbing slope 316, the shaft 53 snaps into each fastening hole 314 by the restoring force of each support arm 52, so as to achieve a stable fixing effect (as shown in FIG. 6).

Figure 7:
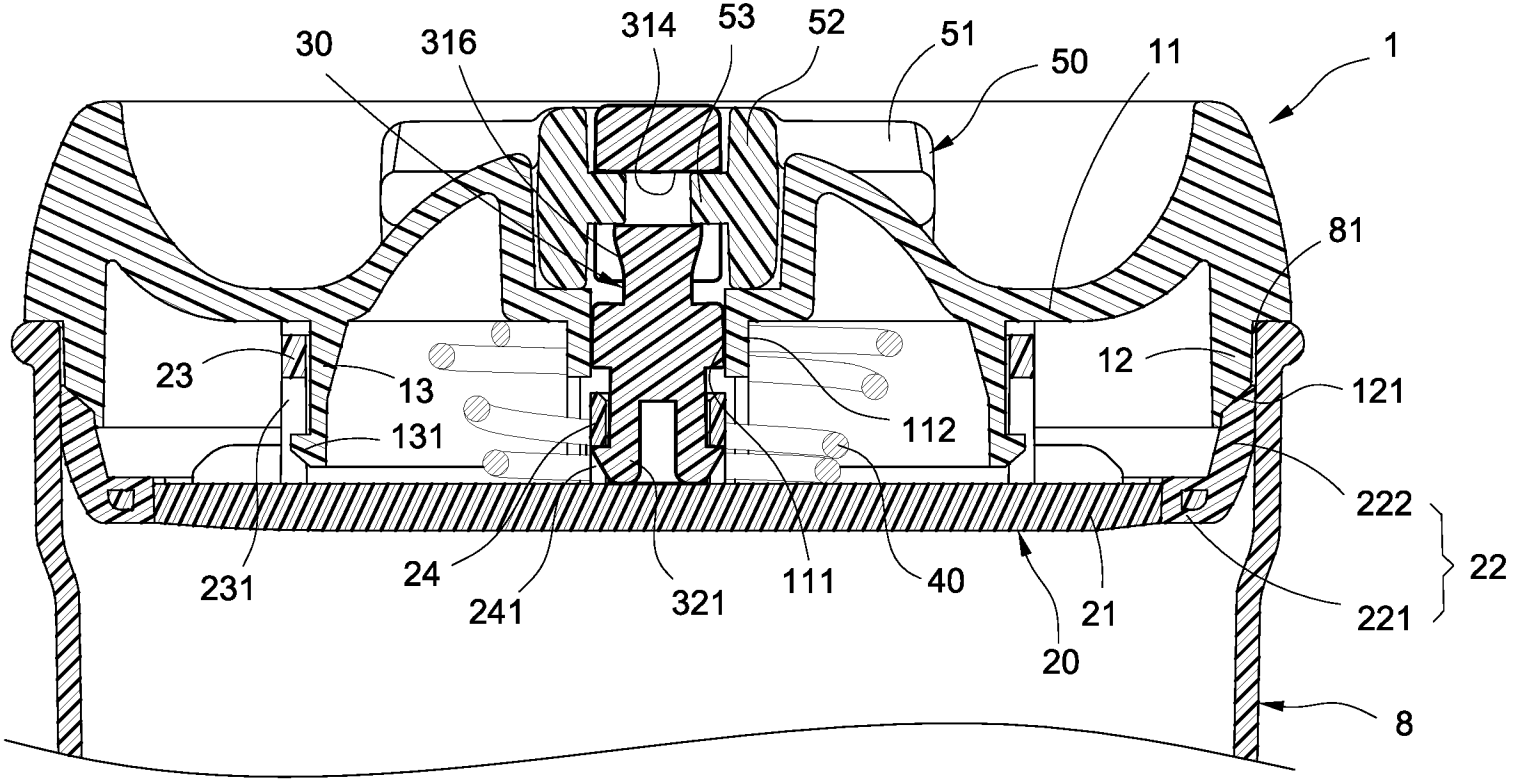
FIG. 7 is a cross-sectional view showing a using status of a sealing cover with the two-way embedding buckle mechanism and a container in accordance with this disclosure.

During operation, the knob handle 51 is turned clockwise or counterclockwise, so that each shaft 53 is pivoted in the fastening hole 314, and a side of each support arm 52 contacts the outer surface of the top plate 11 (as shown in FIG. 7), (in other words, the distance from a side of the support arm 52 to the shaft 53 is greater than the distance from the bottom of the support arm 52 to the shaft 53, or there is a height difference in the aforementioned configuration). The lower cover member 20 moves towards the upper cover member 10, and the peripheral wall 112 is adapted to sheathe the outer periphery of the fastener 30, so that the lower cover member 20 may be guided and moved stably, and the squeezed-deformed section 222 of the seal ring 22 may be sealed between the stop slope 12 and an inner wall of the container 8.

While this disclosure has been described by means of specific embodiments, numerous modifications and variations could be made thereto by those skilled in the art without departing from the scope and spirit of this disclosure set forth in the claims.

What is claimed is:

1. A sealing cover with a two-way embedding buckle mechanism, the sealing cover comprising:

an upper cover member, comprising a top plate and a through hole disposed on the top plate;

a lower cover member, installed under the upper cover member and comprising a bottom plate;

a fastener, coupled to the bottom plate and passing through the through hole to be exposed from the top plate, and comprising two embedded buckle channels corresponding to each other, and each of the embedded buckle channels comprising a sliding path, a first embedding port and a second embedding port, and the first embedding port and the second embedding port disposed on two ends of the sliding path respectively;

an elastic element, elastically clamped between the top plate and the bottom plate; and a handle member, comprising a knob handle and two support arms extended from the knob handle, and each of the support arms comprising a shaft extended therefrom, and each of the shafts selectively entering one of the first embedding ports and the second embedding ports and moving in each of the sliding paths.

2. The sealing cover with the two-way embedding buckle mechanism in claim 1, wherein the sliding path is in an inverted V-shape.

3. The sealing cover with the two-way embedding buckle mechanism in claim 2, wherein the sliding path comprises a fastening hole disposed on a tip position thereof and a boss disposed under the fastening hole.

4. The sealing cover with the two-way embedding buckle mechanism in claim 3, wherein each of the sliding paths comprises a climbing slope disposed therein on a lower edge of the fastening hole, and each of the shafts is latched and positioned in the fastening hole by passing through each of the climbing slopes.

5. The sealing cover with the two-way embedding buckle mechanism in claim 3, wherein the boss is in a triangular shape.

6. The sealing cover with the two-way embedding buckle mechanism in claim 1, wherein the upper cover member further comprises a ring frame extended outwardly from the top plate, and the ring frame comprises a stop slope disposed thereon, and the lower cover member further comprises a seal ring coupled to the bottom plate and an end of seal ring is disposed on an outer side of the stop slope.

7. The sealing cover with the two-way embedding buckle mechanism in claim 6, wherein the top plate comprises a peripheral wall extended around a periphery of the through hole, and an upper collar is extended between the peripheral wall and the ring frame, and the bottom plate comprises a lower collar extended correspondingly to the upper collar, and the lower collar and the upper collar are engaged with each other.

8. The sealing cover with the two-way embedding buckle mechanism in claim 7, wherein the upper collar comprises a plurality of elastic hooks, and the lower collar comprises a plurality of hook guide slots, and each of the elastic hooks is fastened to each of the hook guide slots correspondingly.

9. The sealing cover with the two-way embedding buckle mechanism in claim 7, wherein the bottom plate comprises a rectangular frame extended therefrom and two snap holes disposed on the rectangular frame corresponding with each other, and the fastener comprises an insert block, and the insert block comprises a snap hook disposed on two corresponding sides thereof respectively, and the insert block is plugged in the rectangular frame and each of the snap hooks is fixed to each of the snap holes correspondingly.

10. The sealing cover with the two-way embedding buckle mechanism in claim 6, wherein the seal ring comprises a connection section and a squeezed-deformed section extended from the connection section, and the connection section is fixed to a periphery of the bottom plate, and the squeezed-deformed section is extended in a direction toward the upper cover member and disposed on the outer side of the stop slope.

* * * * *